US011049480B1

(12) United States Patent
Chern

(10) Patent No.: US 11,049,480 B1
(45) Date of Patent: Jun. 29, 2021

(54) BOW FOR MUSICAL STRING INSTRUMENT

(71) Applicant: Chyh-Hong Chern, Taipei (TW)

(72) Inventor: Chyh-Hong Chern, Taipei (TW)

( * ) Notice: Subject to any disclaimer, the term of this patent is extended or adjusted under 35 U.S.C. 154(b) by 0 days.

(21) Appl. No.: 17/083,996

(22) Filed: Oct. 29, 2020

(51) Int. Cl.
*G10D 3/16* (2020.01)

(52) U.S. Cl.
CPC ..... *G10D 3/16* (2013.01)

(58) Field of Classification Search
CPC ..... G10D 3/00; G10D 3/16; G10D 3/05
See application file for complete search history.

(56) References Cited

U.S. PATENT DOCUMENTS 3,759,131 A * 9/1973 Brock ..... G10D 3/16 84/282
5,355,757 A * 10/1994 Plummer ..... G09B 15/06 84/283

* cited by examiner

*Primary Examiner* — Kimberly R Lockett
(74) *Attorney, Agent, or Firm* — Birch, Stewart, Kolasch & Birch, LLP

(57) ABSTRACT

A bow includes a stick, a tip formed at one end of the stick, a frog including a projection that has an eyelet and that is received in a mortise of the stick, a hair ribbon held between the tip and the frog, a screw inserted into the stick in a longitudinal direction of the stick and extending through the eyelet, and a tonal enhancer. The screw is rotatable to cause the frog to move relative to the tip in the longitudinal direction. The tonal enhancer is made of a material having Young's modulus less than 3.5 GPa and is sandwiched between the stick and the screw.

7 Claims, 5 Drawing Sheets

BOW FOR MUSICAL STRING INSTRUMENT

FIELD

The disclosure relates to a bow for a musical string instrument and more specifically to a bow provided with a tonal enhancer.

BACKGROUND

To play a musical string instrument, such as a violin, a viola or a cello, a bow is used to pull its strings so as to make the strings vibrate to produce sound. The same musical string instrument could sound very differently with different bows.

Making bows requires delicate skills. Many properties of a bow, such as material and elasticity of the stick, weight distribution, the way the hank of bow hair is wrapped, etc., affect the quality of the bow and the feeling of handling the bow, and the bow would in turn greatly affect the sound quality produced by a musical string instrument with the bow. This is the reason why in competitions held by the Violin Society of America, bows and violins are evaluated separately.

SUMMARY

Therefore, an object of the disclosure is to provide a bow, with which tone of sound produced by a musical string instrument may be enhanced.

The bow includes a stick having opposite first and second ends and a mortise formed near the second end, a tip formed at the first end of the stick, a frog including a projection that has an eyelet that is received in the mortise, a hair ribbon held between the tip and the frog, a screw inserted in a longitudinal direction of the stick from the second end into the stick and extending through the eyelet, and a tonal enhancer.

The screw is configured to be rotatable to cause the frog to move relative to the tip in the longitudinal direction. The tonal enhancer is made of a material having Young's modulus less than 3.5 GPa, and is sandwiched between the stick and the screw.

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1:
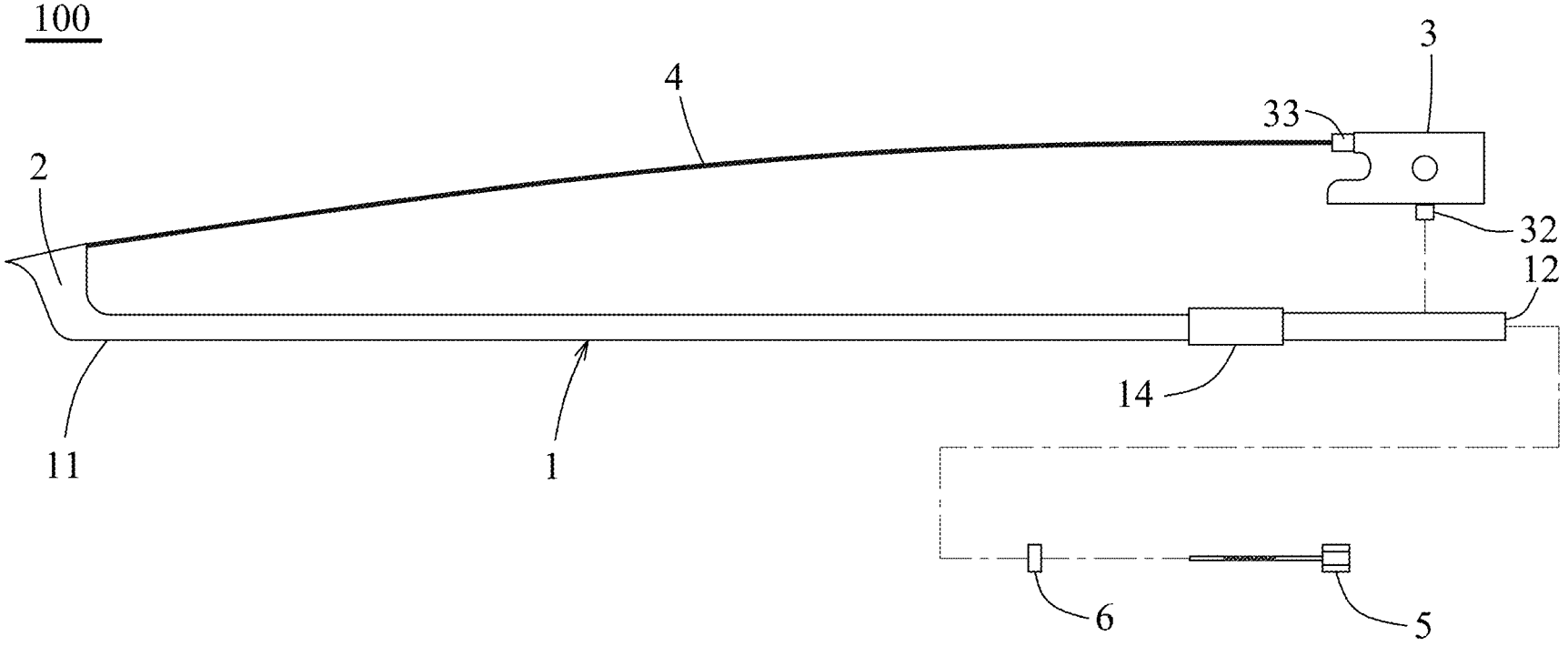
FIG. 1 is a schematic view illustrating one embodiment of a bow according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, one embodiment of a bow 100 according to this disclosure, with which tone of sound produced by a musical string instrument may be enhanced, includes a stick 1 that has a first end 11 and a second end 12 opposite to each other, a tip 2 that is formed at the first end 11, a frog 3 that is installed on the stick 1 near the second end 12, a hair ribbon 4 that is held between the tip 2 and the frog 3, a screw 5 that is used to adjust a position of the frog 3 on the stick 1, and a tonal enhancer 6. In this embodiment, the stick 1 and the tip 2 are formed as one piece.

Figure 2:
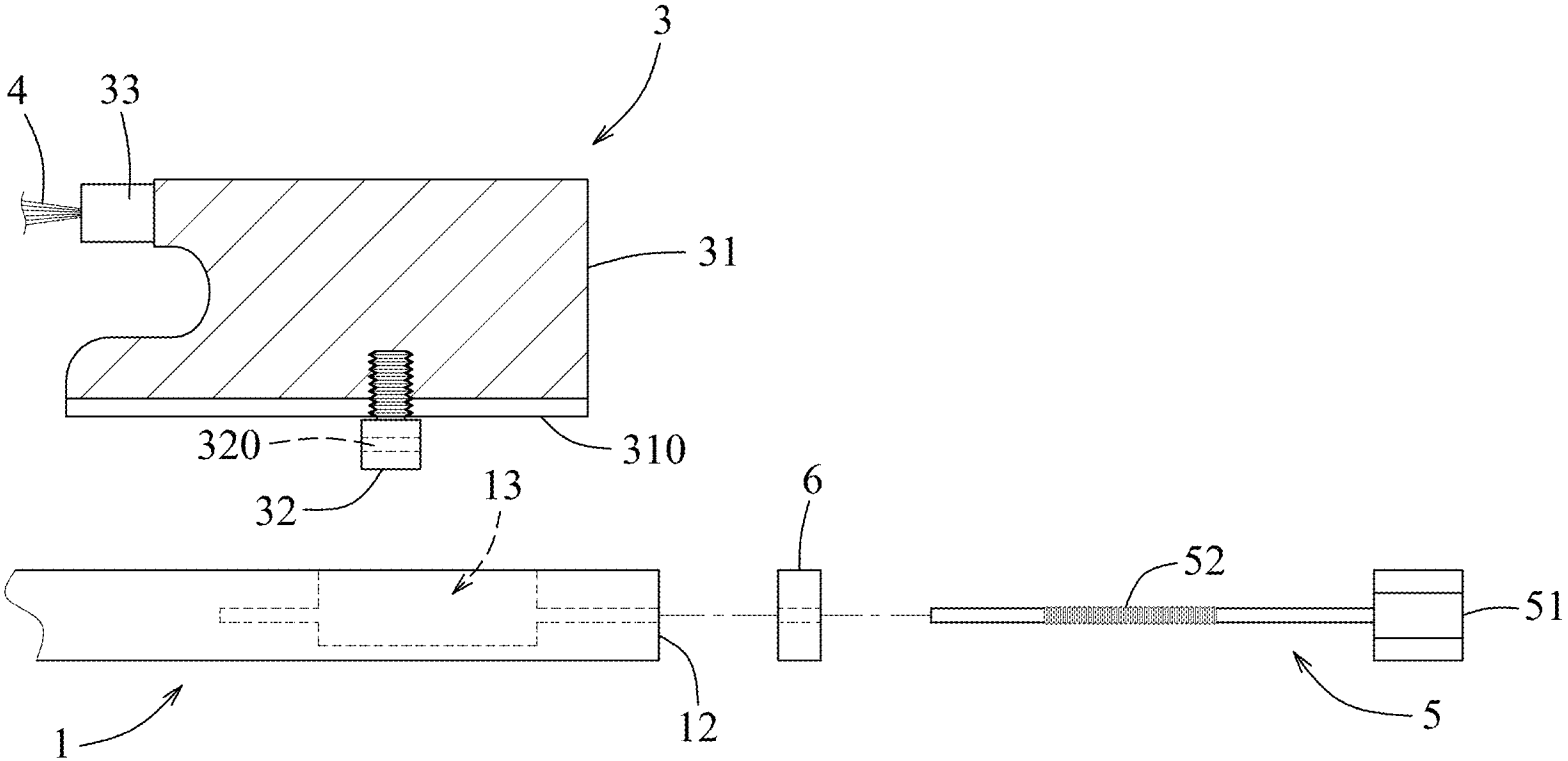
FIG. 2 is a fragmentary partially-sectional view illustrating components of the bow according to the embodiment.
Figure 3:
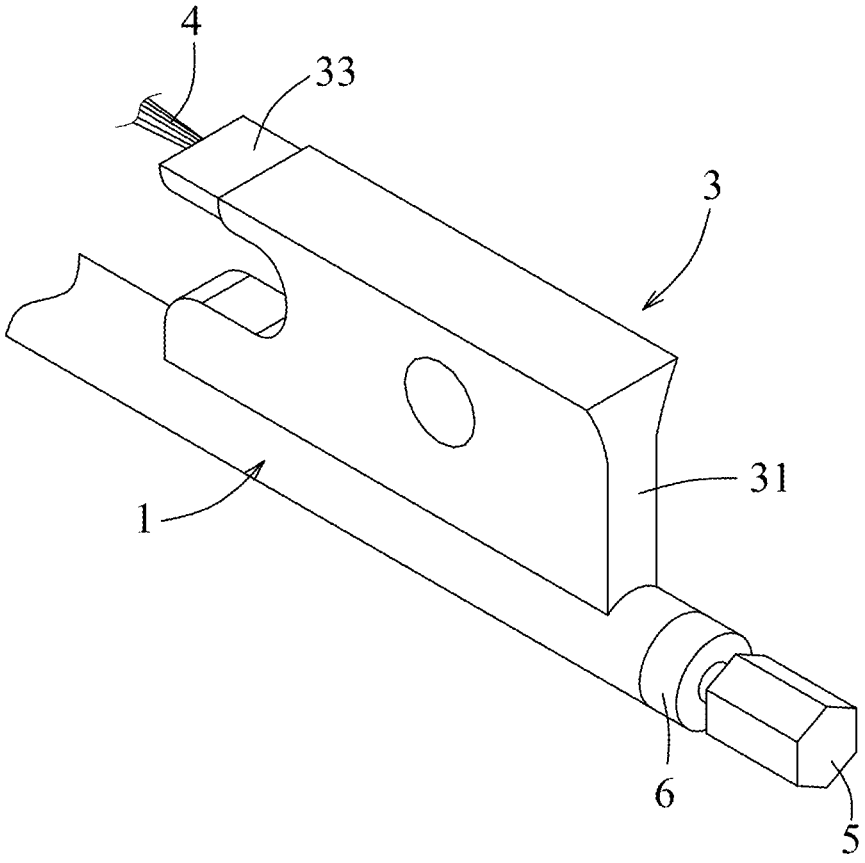
FIG. 3 is a fragmentary schematic view illustrating the bow according to the embodiment.

Further referring to FIGS. 2 and 3, the stick 1 further has a mortise 13 that is a rectangular hole formed near the second end 12.

The frog 3 includes a main body 31 having a bottom side 310 that is configured to be fittingly attached to the stick 1, a projection 32 fastened at and projecting from the bottom side 310 of the main body 31, and a ferrule 33 bound at the main body 31 and surrounding the hair ribbon 4 to serve as a guide to flatten and widen the hair ribbon 4. The mortise 13 is longer than the projection 32 in a longitudinal direction of the stick 1 of the bow 100, so that the projection 32 may be movably received in the mortise 13. The projection 32 is formed with a threaded hole that serves as an eyelet 320.

The tonal enhancer 6 is made of a material having Young's modulus substantially equal to or less than 3.5 GPa. In some embodiments, Young's modulus of the material of the tonal enhancer 6 is substantially equal to or less than 1 GPa. In this embodiment, the tonal enhancer 6 is made of a material selected from the group consisting of sponge, rubber, foams, silicone, emulsions, and combinations thereof. The tonal enhancer 6 may be designed in a form of, but not limited to, a circular disc, a ring, a block or a ball.

The screw 5 includes a head 51, and a shank 52 that is at least partially threaded and that is connected to the head 51. To attach the frog 3 to the stick 1, the projection 32 is first received in the mortise 13, the tonal enhancer 6 is placed at the second end 12 of the stick 1, and then the shank 52 of the screw 5 extends through the tonal enhancer 6 and is inserted into the stick 1 in the longitudinal direction in such a way that the tonal enhancer 6 is sandwiched between the second end 12 of the stick 1 and the head 51 of the screw 5, so as to provide acoustic insulation between the stick 1 and the screw 5. Further, the shank 52 of the screw 5 extends through the eyelet 320. In addition, the shank 52 of the screw 5 is screwed into and threadedly engages the eyelet 320, such that the screw 5 may be rotated to cause the frog 3 to move relative to the tip 2 in the longitudinal direction, thereby adjusting the tightness of the hair ribbon 4.

Figure 4:
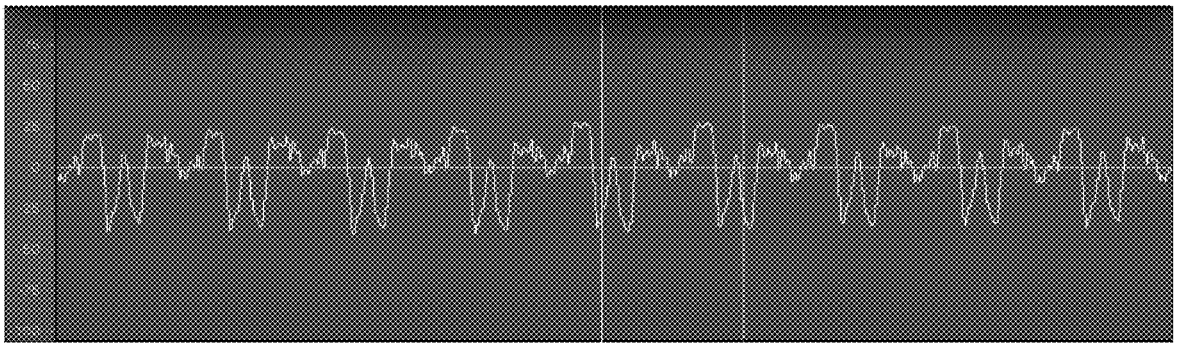
FIGS. 4 and 5 are sound waveforms produced by an open E string of a violin with the same bow provided with and without a tonal enhancer of the disclosure.
Figure 5:
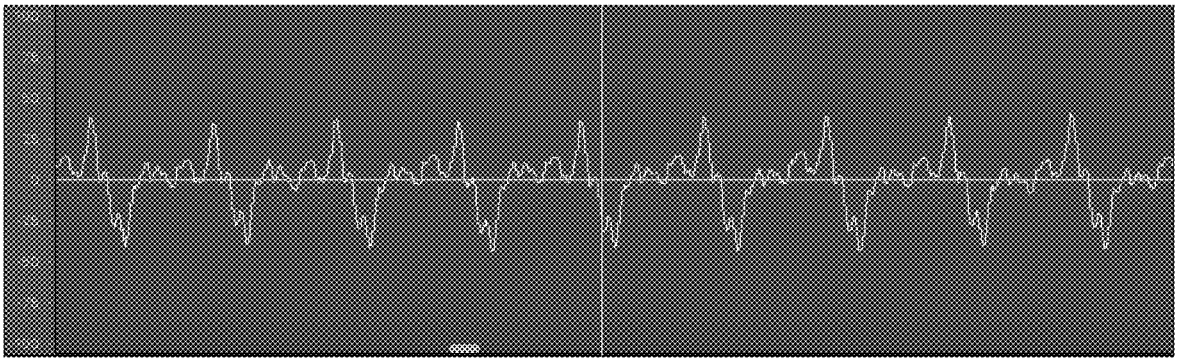

Speaking of the function of the tonal enhancer 6, a conventional bow (not shown) that comes without a tonal enhancer causes an open E string of a violin (not shown) to vibrate and to produce sound with a waveform shown in FIG. 4, while the bow 100 including the tonal enhancer 6 according to the disclosure causes the same open E string of the violin to vibrate and to produce sound with a waveform shown in FIG. 5. It is evident that, compared with the waveform of FIG. 4, the waveform of FIG. 5 has a greater number of fine structures (indicating more subharmonics) and sharper peaks, and such features imply relatively richer tones.

Figure 6:
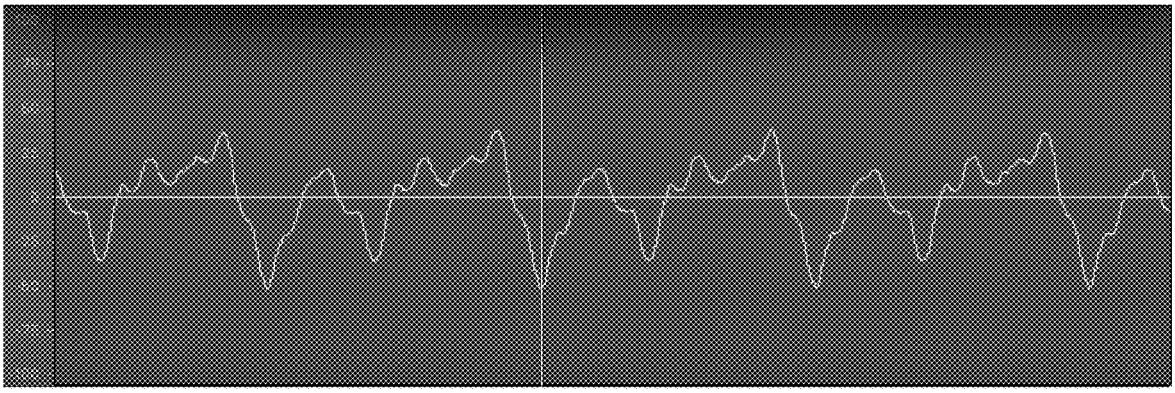
FIGS. 6 and 7 are sound waveforms produced by an open D string of the violin with the same bow provided with and without a tonal enhancer of the disclosure.
Figure 7:
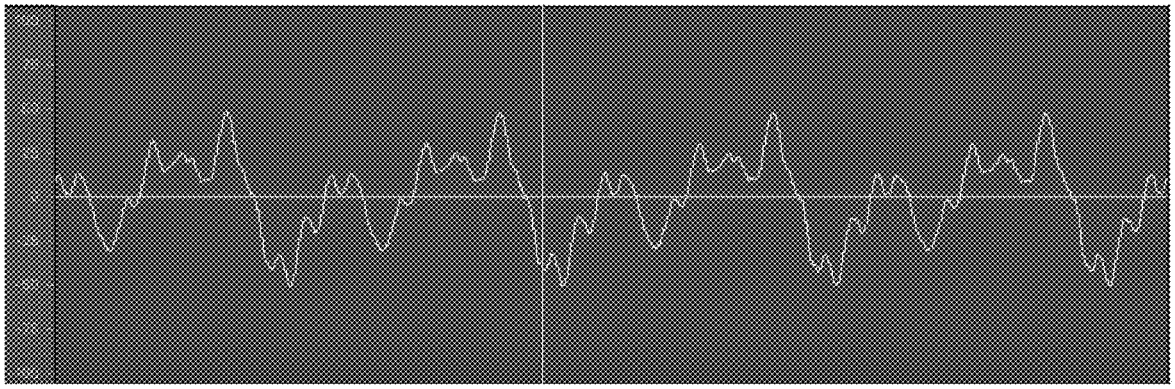

Similar effect may be observed in other strings. For example, when the conventional bow causes an open D string of the violin to vibrate, the sound produced by the open D string has a waveform shown in FIG. 6, while the bow 100 according to the disclosure causes the open D string of the violin to vibrate and to produce sound with a waveform shown in FIG. 7. Compared with the waveform of FIG. 6, the waveform of FIG. 7 has a greater number of fine structures and sharper peaks.

In summary, the bow 100 of the present disclosure including the tonal enhancer 6 sandwiched between the stick 1 and the screw 5 allows the instrument to produce sound with superior sound quality. It is also noted that, since the tonal enhancer 6 is placed at the second end 12 of the stick 1, where the player holds, and since the tonal enhancer 6 is quite lightweight, the tonal enhancer 6 will not affect the feeling of handling the bow 100.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A bow comprising:

a stick having a first end, a second end opposite to said first end, and a mortise formed near said second end;

a tip formed at said first end of said stick;

a frog including a projection that has an eyelet and that is received in said mortise;

a hair ribbon held between said tip and said frog;

a screw inserted from said second end into said stick in a longitudinal direction of said stick, to extend through said eyelet, and configured to be rotatable to cause said frog to move relative to said tip in the longitudinal direction; and a tonal enhancer made of a material having Young's modulus less than 3.5 GPa, and sandwiched between said stick and said screw.

2. The bow of claim 1, wherein said screw includes a head, and a threaded shank that is connected to said head and that extends through said tonal enhancer, wherein said tonal enhancer is sandwiched between said second end of said stick and said head of said screw.

3. The bow of claim 2, wherein said eyelet is a threaded hole, and said threaded shank of said screw is screwed into said eyelet to drive said frog to move.

4. The bow of claim 1, wherein said frog includes a main body having a bottom side that is fittingly attached to said stick, and said projection is fastened at and projects from said bottom side of said main body.

5. The bow of claim 1, wherein said tonal enhancer is made of a material having Young's modulus less than 1 GPa.

6. The bow of claim 1, wherein said tonal enhancer is made of a material selected from the group consisting of sponge, rubber, foams, silicone, emulsions and combinations thereof.

7. The bow of claim 1, wherein said tonal enhancer is in a form of one of a circular disc, a ring, a block, and a ball.

* * * * *